US006283025B1

(12) United States Patent
Simeth

(10) Patent No.: US 6,283,025 B1
(45) **Date of Patent: *Sep. 4, 2001**

(54) MULTICOLOR SHEET-FED PRINTING PRESS

(75) Inventor: Claus Simeth, Geisenheim (DE)

(73) Assignee: Man Roland Druckmaschinen AG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/230,327

(22) PCT Filed: Jul. 23, 1997

(86) PCT No.: PCT/EP97/03980

§ 371 Date: Mar. 26, 1999

§ 102(e) Date: Mar. 26, 1999

(87) PCT Pub. No.: WO98/03337

PCT Pub. Date: Jan. 29, 1998

(30) Foreign Application Priority Data

Jul. 24, 1996 (DE) ..... 196 29 822

(51) Int. Cl.[7] ..... B41F 5/16; B41F 5/18; B41F 5/02

(52) U.S. Cl. ..... 101/183; 101/230

(58) Field of Search ..... 101/137, 142, 101/175, 177, 183, 217, 246, 230, 136, 174, 181, 229, 389.1

(56) References Cited

U.S. PATENT DOCUMENTS

| | | | | |
|---|---|---|---|---|
| 1,911,048 | * | 5/1933 | Adsit et al. . | |
| 2,297,846 | * | 10/1942 | Van Benschoten | 350/320 |
| 2,909,117 | * | 10/1959 | Crissy | 101/137 |
| 2,911,907 | | 11/1959 | Davidson . | |
| 2,981,181 | * | 4/1961 | Levien | 101/217 |
| 3,347,160 | | 10/1967 | Roozee . | |
| 3,384,011 | | 5/1968 | Bolza-Schünemann . | |
| 3,949,670 | | 4/1976 | Katsuji . | |
| 4,370,926 | * | 2/1983 | Hattori | 101/207 |
| 4,777,876 | * | 10/1988 | Ishii | 101/177 |
| 5,353,703 | * | 10/1994 | Rieker | 101/177 |
| 5,469,787 | * | 11/1995 | Turner et al. | 101/211 |
| 5,579,691 | * | 12/1996 | Voge | 101/246 |
| 6,205,919 | * | 3/2001 | Simeth | 101/183 |

FOREIGN PATENT DOCUMENTS

| | | | |
|---|---|---|---|
| 2435203C2 | * | 10/1981 | (DE) . |
| 34 197 62 A1 | | 11/1985 | (DE) . |
| 4303797A1 | * | 8/1994 | (DE) . |
| 2.082.082 | | 11/1971 | (FR) . |
| 1 419 966 | | 12/1975 | (GB) . |
| WO95/25015 | | 9/1995 | (WO) . |

* cited by examiner

*Primary Examiner*—Kimberly L. Asher
(74) *Attorney, Agent, or Firm*—Leydig, Voit & Mayer, Ltd.

(57) ABSTRACT

A printing machine which allows for the economic production of multi-color prints and allows for automation of the printing process is provided. The printing machine according to the collect-run principle in which the multicolor prints are collected on a rubber cylinder. In a single printing unit, the printing machine can also process two different printing inks. To execute the collect-run printing operation, the sheets are fed in a cycle offset to the collection of the images on the rubber cylinder. This enables very compact and simply structured printing machine configurations.

13 Claims, 5 Drawing Sheets

MULTICOLOR SHEET-FED PRINTING PRESS

FIELD OF THE INVENTION

The present invention relates generally to printing machines, and more particularly to a sheet-fed rotary printing machine for multicolor printing.

BACKGROUND OF THE INVENTION

It is a known practice in the printing of small-format printing sheets to use printing units in which the cylinders participating in the printing, such as a plate cylinder, a rubber or blanket cylinder and a printing cylinder, have different diameters. Through the use of cylinders of different diameters it is possible to save material costs with regard to the printing plates, the rubber blankets or the printing cylinder.

A sheet-fed rotary printing machine is disclosed in DE-PS 24 35 203. This printing machine includes in its most diverse configurations plate cylinders with a single or simple diameter, a rubber cylinder with a multiple diameter and a printing cylinder with a single diameter. With this arrangement, a partial portion of a print image can be printed on one of several segments of the rubber cylinder from differently installable printing units of a particular plate cylinder. Simultaneously, this print image can be printed on a printing sheet led on the printing cylinder. In such a system, the printing sheet revolves with the printing cylinder in correspondence to the movement of the segments of the rubber cylinder and is thereby printed.

In U.S. Pat. No. 3,347,160 there is described an ink roller device for a multicolor rotary offset printing machine. The printing machine disclosed in this reference includes a plate cylinder and a rubber cylinder, each having a multiple diameter, to which there is allocated a printing cylinder having a single or simple diameter. In the printing operation, the print image consists of several image parts that are generated on the plate cylinder of several cycled inking and moistening units, the image parts are transferred to the large, multiple-sized rubber cylinder and printed on a printing sheet guided on the printing cylinder. The printing cylinder revolves multiple times in correspondence to the diameter ratio between the rubber cylinder and the printing cylinder, until all of the print image parts are transferred to the printing sheet. This multicolor printing machine is particularly suited for so-called proof printing. The problem with these devices is that while they can be arranged as individual printing units, the costs associated with printing with images that contain more ink than permitted by the particular printing machine are very high. Accordingly, these printing machines are suited only for special printing processes.

OBJECTS AND SUMMARY OF THE INVENTION

An object of the invention is to provide a printing machine having a configuration that provides a simple construction and selectively combinable printing units for generating printing sheets with a differing number of colors.

An additional object of the invention is to provide a printing machine which eliminates the need to exchange aggregates or assemblies and is suited for high throughput with arbitrary edition levels.

A further object of the invention is to provide a printing machine of the foregoing type which utilizes standard elements so as to produce a simple, and thereby, cost efficient printing machine and whereby the elements can be used in different combinations so as to produce differently configured multicolor prints at an optimal performance level without having to re-outfit the printing machine.

The present invention provides these and other advantages and overcomes the drawbacks of the prior art by providing a sheet-fed printing machine for printing in one or more colors in which the plate cylinders are provided with two printing plates and the rubber cylinders have only a simple or single diameter. The present invention offers the particular advantage that as compared to standard printing machines, the printing machine configurations of the present invention are very simple and permit, with minimal expenditure, cost effective printing processes, in which consideration is given to a so-called "slim" or slender sheet running. Moreover, the costs for manufacturing the printing machine are reduced through the use of simple elements.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
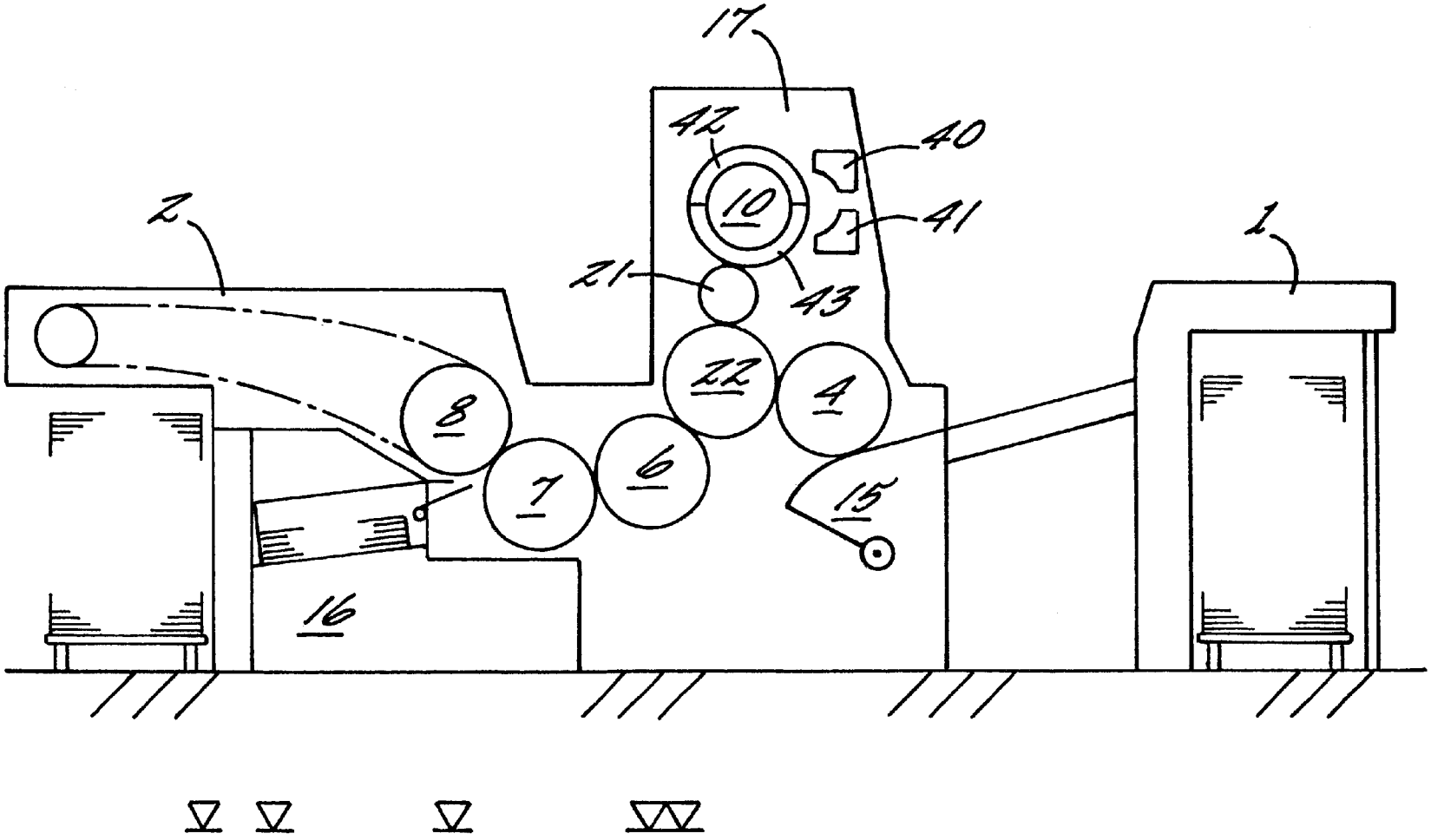
FIG. 1 is a schematic side elevation view of a two-color printing machine with a rubber cylinder with simple or single diameter in accordance with the present invention.

A printing machine configured in accordance with the teachings of the present invention is schematically illustrated in FIG. 1. The printing machine includes a printing unit 17 arranged between a feeder unit 1 and a discharge or delivery unit 2. In a known manner, the printing unit 17 includes a feed drum 4, which cooperates with a pre-gripper system 15, a plate cylinder 10, a first sheet guide drum 6, a second sheet guide drum 7 and a discharge or delivery drum 8.

In accordance with an important aspect of the present invention, the printing unit 17 further includes a printing cylinder 22, which has a double diameter, i.e. it has a circumference which corresponds to two format-lengths. Thus, the printing cylinder can have one or two working surfaces. The printing cylinder cooperates with a rubber or blanket cylinder 21, which has only a simple or single diameter, i.e. it has a circumference which corresponds to one format-length. The printing machine of the present invention operates, when not being used for printing in a single color, according to the so-called rubber collecting print process. This means that upon rotation of the rubber cylinder 21, two partial images of a print image provided, in this case, by two printing plates 42, 43 on the plate cylinder 10 overlay one another and are then printed simultaneously on a printing sheet that is held on the printing cylinder 22 in a printing zone.

As will be appreciated, the diameter ratio (e.g., single or double diameter) of the printing and rubber cylinders relates to the maximum length of a printing sheet that could be processed by the printing machine. In this case, the feed drum 4 and the plate cylinder 10 arranged in the printing unit 17 also have a double diameter. To the extent that the sheet-guiding cylinders or drums are also provided with a double diameter, they can be equipped with one or two gripper rows for the transport of printing sheets. With regard to print images, as a rule, with several print images, what are meant are the differently colored partial images of a multi-color print. This is not the case, however, when only performing monochrome printing.

The printing machine shown in FIG. 1 also has an additional auxiliary discharge unit 16. At the auxiliary discharge unit 16, a proof sheet can be laid out as required or the unit can be used as waste discharger. The auxiliary discharge unit 16 operates through delivery of a printing sheet from the discharge drum 8 by means of a flexible control arrangement in engagement with the grippers of the discharge drum 8.

Advantageously, various printing processes or modes of operation are possible using a printing machine having the configuration shown in FIG. 1. In one process, a monochrome image can be printed on printing sheets that are held on the printing cylinder 22 on each rotation of the rubber cylinder 21. In this case, a series of two working surfaces and two gripper rows must be provided on the printing cylinder 22 which on each revolution are individually charged with a printing sheet. Likewise, two identical print images for printing in a single color must be provided on the plate cylinder 10.

Where only a single print image is provided on the plate cylinder 10, the printing machine is operable with singly occupied sheet-guiding drums or cylinders with full throughput, i.e. with one printing sheet per revolution. Alternatively, the printing cylinders can be doubly occupied with two working surfaces, however, only every other gripper row is charged with a printing sheet so that a print image is generated in the printing zone between rubber cylinder 21 and printing cylinder 22 only on every other revolution of the rubber cylinder.

Finally, as described earlier, with this printing machine configuration, two differently colored partial images of a single print image can be provided on the plate cylinder. In such case, upon the revolution of the rubber cylinder 21, first one print image is transferred to the rubber blanket and then the second print image is overlaid on the first print image. The two print images overlaid on one another are then simultaneously printed on the printing sheet held in the printing zone defined between the rubber cylinder 21 and the printing cylinder 22. Thus, upon each revolution of the rubber cylinder 21, a two-colored print can be generated with the printing machine operating with half throughput, i.e. with the charging of every other gripper row on the feed drum 4 or printing cylinder 22 with a printing sheet. Of course, the charging of every other gripper row is necessary only where each sheet-guiding cylinder of the printing machine has two working surfaces and two gripper rows.

Figure 2:
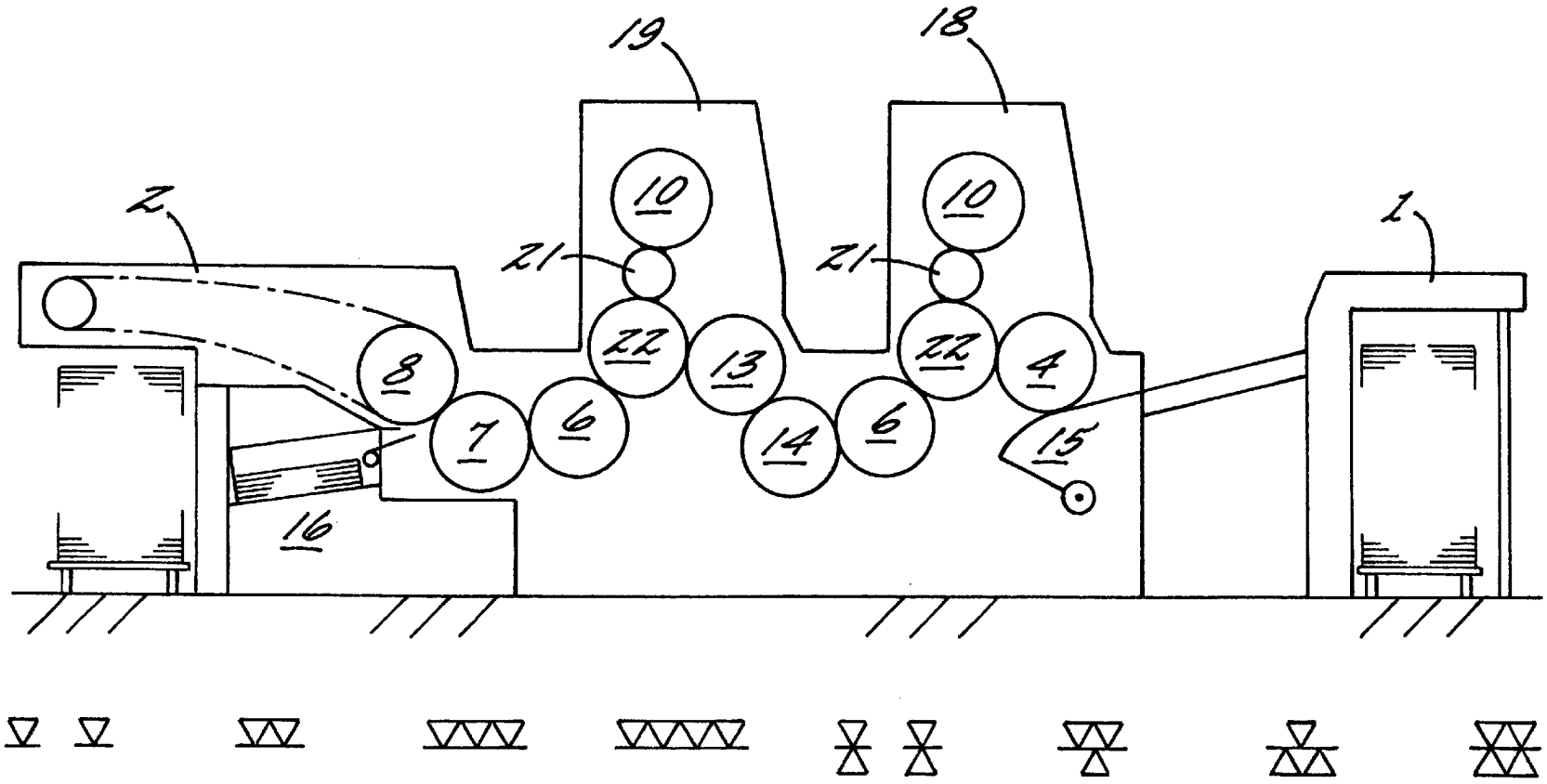
FIG. 2 is a schematic side elevation view of a four-color printing machine having two printing units configured similar to the printing units of the printing machine shown in FIG. 1.

An alternative embodiment having the same basic configuration as the printing machine of FIG. 1 is shown in FIG. 2. To allow for more printing options, however, the embodiment of the invention shown in FIG. 2 includes multiple printing units. Specifically, two printing units 18 and 19 are arranged between the feeder unit 1 and the discharge unit 2. Each of these printing units is configured the same as the printing unit 17 of the printing machine shown in FIG. 1. In particular, both printing units 18, 19 include a plate cylinder 10, a rubber cylinder 21, a printing cylinder 22 and a sheet guide drum 6. In a similar manner to the embodiment of FIG. 1, the feed drum 4 is allocated to the printing cylinder of the first printing unit 18 and a sheet guide drum 13 is allocated to the printing cylinder 22 of the second printing unit 19. Likewise, as in the embodiment of FIG. 1, the feed drum 4 cooperates with a pre-gripper system 15 and a sheet guide drum 7 is provided which leads to a discharge drum 8. Finally, the two printing units are connected by an additional sheet guide drum 14. This configuration of the printing machine of the present invention permits images having up to four different colors to be printed on sheets with the machine operating at different throughputs.

Fundamentally, this embodiment of the printing machine also operates according to the rubber collecting printing process like the embodiment of FIG. 1. As such, in each of the two printing units 18 and 19 a two-color print can be generated. As will be appreciated, these two prints can be adapted to supplement each other so that a print image having a total of four colors can be produced. This four-color print is generated after the machine executes a starting phase which includes a total of two revolutions of the respective rubber cylinders 21 of the two printing units. Alternatively, however, a monochrome image can be provided on the plate cylinder 10. With such an arrangement of the plate cylinder, this embodiment of the printing machine would print in two colors and would generate a printed sheet only on every other revolution of the rubber cylinder 21. In other words, the printing machine would generate a sheet printed in two colors on each revolution of the printing cylinder 22.

Moreover, the printing machine shown in FIG. 2 can be arranged so that two print images in one color are provided on the plate cylinder 10. Accordingly, on each revolution of the rubber cylinder 21, a print image can also be transferred to the printing cylinder 22. Once again, the printing machine can operate with the full throughput on the printing cylinder, with two printing sheets per revolution. The printing sheets, however, can then be printed in the first printing unit with one color and in the second printing unit with a second color.

Furthermore, the sheet guide drums 6, 13, 14 can also be configured as a turning arrangement. More specifically, in a known manner, the sheet guide drums 6, 13, 14 could be provided with devices by means of which a printing sheet is removed on its rear edge from the middle sheet guide drum 14 and is fed in inverted position and transport direction to the second printing unit. In the second printing unit, the printing sheet can then be printed on its reverse side. Thus, the printing machine of FIG. 2 can be arranged to print (1) on two sides of a sheet in one color; (2) on one side of a sheet in two colors and on the other side in one color; or (3) on both sides of a sheet in two colors.

Figure 3:
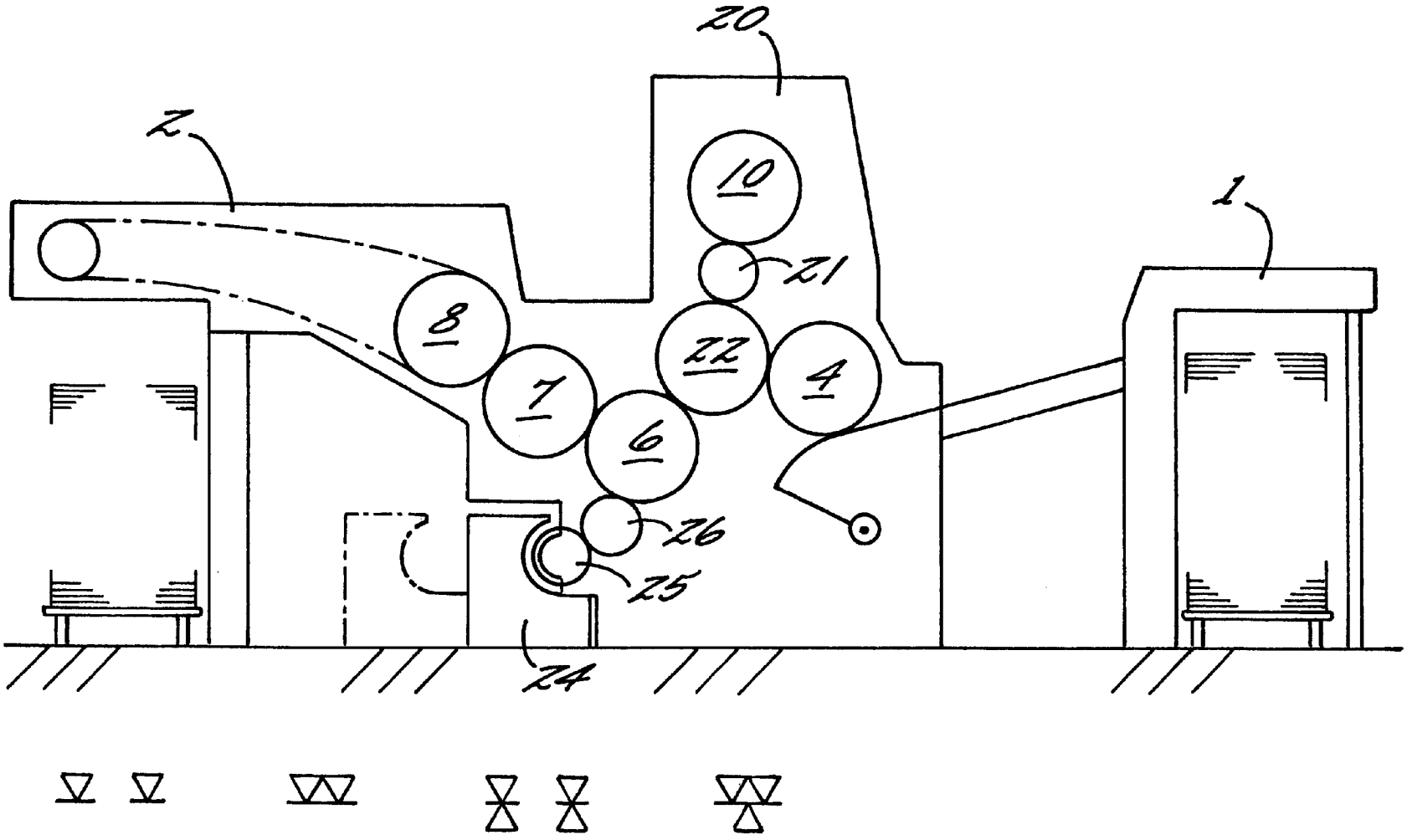
FIG. 3 is a schematic side elevation view of a three-color printing machine with rubber cylinders with single diameter and a perfecting printing unit.
Figure 4:
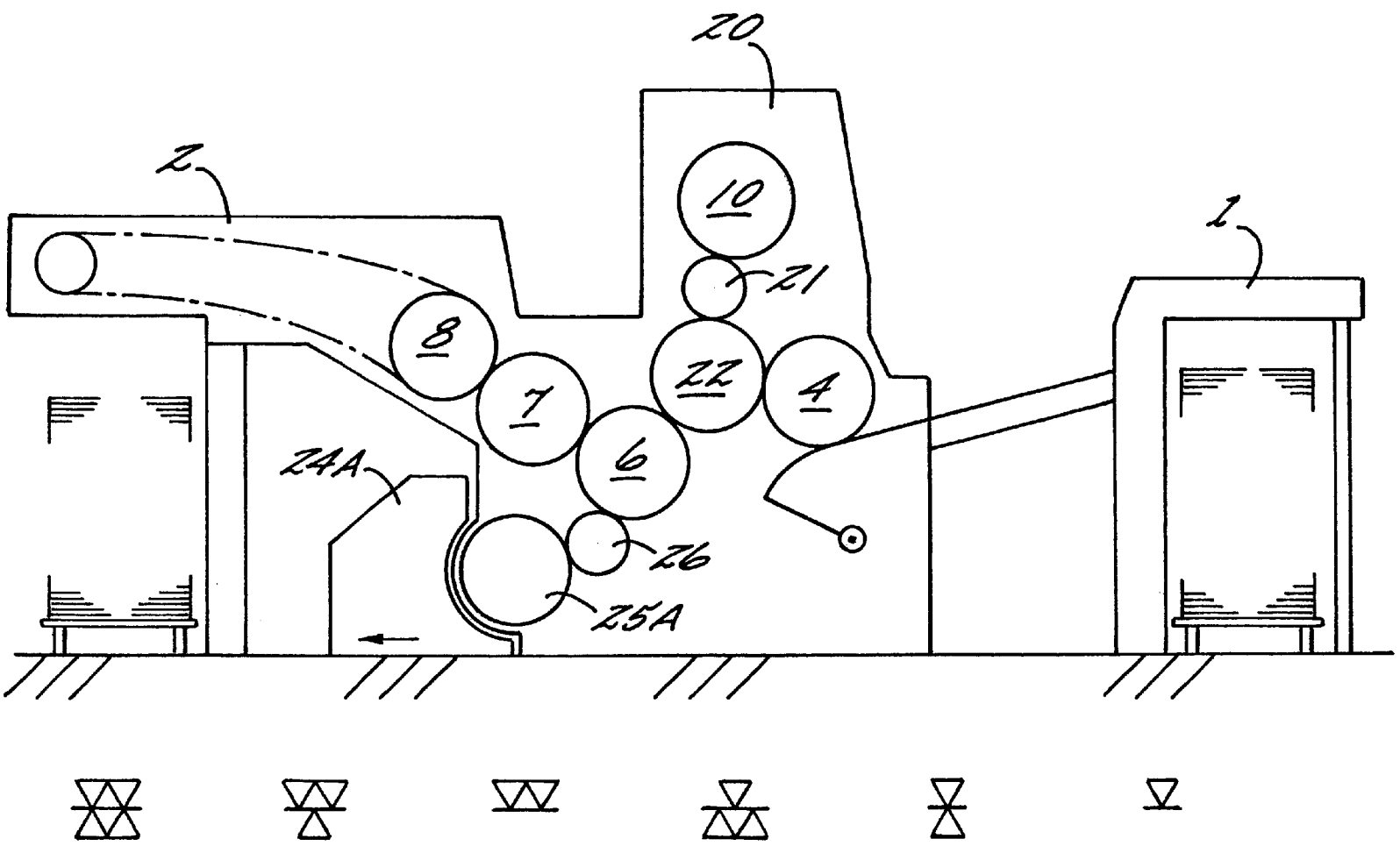
FIG. 4 is a schematic side elevation view of a four-color printing machine with rubber cylinders with single diameter and a perfecting printing unit.

A further alternative embodiment of the basic printing machine configuration of FIG. 1 is shown in FIGS. 3 and 4. The printing machine of FIGS. 3 and 4, like that shown in FIG. 1, has a printing unit 20 arranged between feeder unit 1 and discharge unit 2 which includes a plate cylinder 10, a printing cylinder 22, a feeder drum 4 and a sheet guide drum 6. Further, a rubber cylinder 21 having a single diameter is arranged between the plate cylinder 10 and the printing cylinder 22. The basic configuration of the printing unit 20 is the same as the printing unit 17 shown in FIG. 1. Therefore, the printing unit 20 (FIGS. 3 and 4) functions in the same manner as the printing unit of the FIG. 1 embodiment in that it can produce either monochrome or two-colored prints in different throughputs.

To allow for further variation in the printing process, a second printing unit is allocated to the sheet guide drum 6. This second printing unit consists of a slidably arranged inking mechanism 24, a plate cylinder 25 and a rubber or blanket cylinder 26. The plate cylinder 25 and the rubber cylinder 26 have only a simple or single diameter and, therefore, are only suitable for applying a single printing image color. Significantly, the rubber cylinder 26 of the second printing unit is arranged on the underside of the sheet guide drum 6, which, in this case, takes on the function of a printing cylinder. At this point in the printing machine, the sheet, which was printed on its upper side between rubber cylinder 21 and printing cylinder 22, now contacts the sheet guide drum 6 with its upper side. Thus, the reverse side of the sheet which lies opposite the rubber cylinder 26 can be printed on via the plate and rubber cylinders 25, 26 of the second printing unit. Accordingly, with the printing machine shown in FIG. 3, it is possible to print a two-color image on one side of a sheet and to print a second image on the other side of the sheet. Alternatively, a monochrome image could be printed onto both sides of a sheet.

Referring to FIG. 4, there is shown another alternative embodiment of the present invention which has a configuration similar to that illustrated in FIG. 3. The printing machine shown in FIG. 4 has a perfecting printing unit comprising a plate cylinder 25A having a double diameter combined with a rubber cylinder 26 having a single diameter so that, as in the main printing unit 20, the perfecting print takes place according to the rubber collecting principle. Therefore, the printing machine shown in FIG. 4 is capable of producing sheets having a two-color image on one side and a single color image on the opposing side while operating at half throughput and also sheets printed in two colors on both sides while operating at half throughput. To produce the desired colors for the perfecting printing unit, an inking mechanism 24A which can be slid into operative engagement with the plate cylinder 25A in a known manner. To allow for two color prints, the inking mechanism 24A includes two inking arrangements, and possibly also two moistening arrangements, which alternately can be brought into operative engagement with the plate cylinder 25A, in order to apply one or two colors to the plate cylinder. As will be appreciated, with the printing machines illustrated in FIGS. 3 and 4, images can be printed on both sides of a sheet without the need for a sheet turning operation.

To execute the various production modes which are possible with a printing machine configured in accordance with the present invention, it is important that the inking mechanisms or of the inking and moistening mechanisms on the plate cylinders are adapted so that they can be controlled in a flexible manner. Such control systems, however, are known in the art. More specifically, each inking mechanism 40, 41 (shown schematically in FIG. 1) must be capable of being switched or set on and off the plate cylinder on each revolution of the plate cylinder. In the case of a plate cylinder having a double diameter and two images lying one after the other on the circumference of the cylinder, one way in which this can be accomplished is by arranging two individually driven inking mechanisms 40, 41 lying one after another as shown in FIG. 1 so that they can ink the print images differently. Furthermore, the inking mechanisms should be controllable so that it is possible to ink and thoroughly moisten the two print images with a single color. In such case, only one inking mechanism or combined inking-and-moistening mechanism is continuously set. In addition, the inking mechanisms could also be controllable such that it is possible to operate only one moistening mechanism when applying two printing inks. With such a mode of operation, one moistening mechanism is shut off while the other is operated continuously. Moreover, it is also possible that the printing machine could be provided with only a single moistening mechanism per printing unit. As will be appreciated, through the use of such known control systems for the inking and moistening mechanisms, it is possible to execute all of the potential modes of operation that could be used with a printing machine configured according to the present invention.

In general, a printing unit of a printing machine of the present invention operates as follows. A sheet is fed from a pre-gripper to the feed drum 4 and then conducted onward to the printing cylinder. During the printing operation, the sheet feed is adjusted in such manner that the preliminary run required for the plate cylinder 10 and the rubber cylinder 21 in order to ink the printing plates 42, 43 (shown schematically in FIG. 1) and the rubber blanket is taken into account. Specifically, the printing machine first makes an empty turn, during which the first printing plate 42 is inked. When this inked printing plate 42 reaches the rubber blanket, the second printing plate 43 is inked. Meanwhile, the printing cylinder 22 turns idly, since the second print image still has to be transferred to the rubber blanket. At this stage, the sheet feed must begin, since in the next half-turn the print images collected on the rubber cylinder 21 reach the printing cylinder 22. The sheet feed begins with a half-turn of the feed drum 4 away from the sheet feed from the pre-gripper 15. Thus, the first printing sheet reaches the printing cylinder 22 when the collected print image is ready for transfer from rubber cylinder 21. In the next half turn of the printing machine, once again a printing sheet is not fed in since the print images must now be transferred again from the plate cylinder 10 to the rubber cylinder 21. Once both parts of the image a transferred to the rubber cylinder, the next printing sheet can be fed to the feed drum. Since a sheet is fed to the feed drum only upon each half turn, the feed drum 4 can have a half-occupied configuration, i.e. only one half of the feed drum 4 is provided with a sheet-guiding surface and a gripper system. Alternatively, a doubly occupied feed drum having two gripper rows could be used, however, in the normal mode of operation, the second gripper row is not used. To ensure that printing ink does not pass onto a sheet-guiding surface of the printing cylinder 22, it is advantageous to utilize a printing cylinder 22 having a half-occupied configuration, so that no printing surface is arranged opposite the rubber cylinder 21 during the taking-up of the second print image. Likewise, a waste sheet can be sent in advance, in order to avoid soiling of the printing cylinder.

Figure 5:
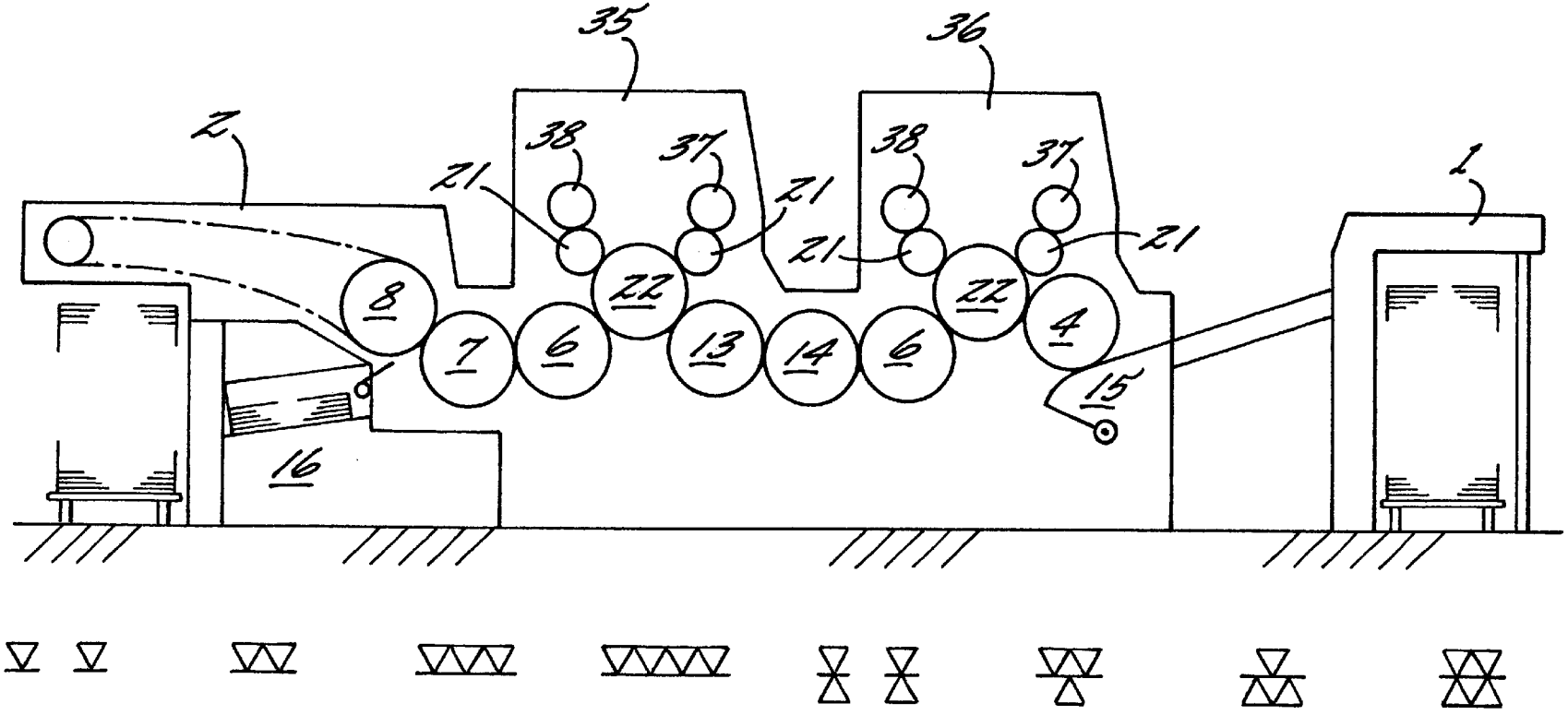
FIG. 5 is a schematic side elevation view of a four-color printing machine with two double printing units and printing cylinders with doubled diameter.

Another embodiment of the present invention which comprises a four-color printing machine with two double printing units 35, 36 is shown in FIG. 5. In accordance with a further aspect of the present invention, each of the printing units 35, 36 of printing machine of FIG. 5 include a pair of plate cylinders 37, 38 having a simple or single diameter.

Each printing unit also includes a printing cylinder 22 on which two print images can be simultaneously printed and a pair of respective rubber cylinders 21 adapted to transfer only one print image. Therefore, in the illustrated embodiment, a pair of plate cylinders 37, 38 having a single diameter and a pair of rubber cylinders having a single diameter are allocated to each printing cylinder 22 in the printing units. In this case, the printing operation also takes place during a single passage of the sheet on the printing cylinder 22. The printing zones defined by the respective rubber cylinders 21 are arranged far enough apart so that the print executed by the first rubber cylinder is completed before the print executed by the second rubber cylinder begins. The printing cylinder 22 can have either one working surface and one gripper row or two working surfaces and two gripper rows with only one gripper row being operable during the printing process.

This configuration can be easily modified to operate in various modes to produce different types of printed sheets in the same manner as the embodiments described earlier. Moreover, by replacing the single-sized plate cylinders 37, 38 with plate cylinders having a double diameter, a four-color print can be produced during each passage of a sheet with each rubber cylinder 21 collecting two print images. Accordingly, the printing machine shown in FIG. 5 can be easily converted for eight-color printing with four-color printing being possible in each of the two printing units 35, 36.

As will be understood by those skilled in the art, the basic multicolor printing process and printing unit configuration of the present invention is equally applicable, therefore, to arrangements where several printing units are arrayed together. With such arrangements, the control of the printing machine in starting or after the run through of the last printing sheet is analogously the same so as to ensure that printing ink cannot pass onto the surfaces conducting printing material. For example, during the running-out of a particular print run, a cylinder setting device can be used in a known manner so as to disengage the rubber cylinder first from the plate cylinder and then from the printing cylinder.

In addition, it will be understood that in addition to conventional offset printing, the present invention is also applicable to indirect intaglio printing or letter-press printing, or also so-called dry offset printing or waterless offset printing. Likewise, these various printing processes can be combined with one another so that different printing processes could be used simultaneously in order, for example, to process special inks and lacquers after the basic printing operation.

The various printing machine configurations of the present invention have very simple constructions and thus are particularly suited for the use of automated mechanisms known in the art with regard to the plate cylinder 10. Specifically, since the plate cylinder has a large diameter, several feed arrangements for imaged printing forms can be easily provided. Moreover, feed arrangements for printing form raw material can be mounted inside the plate cylinder 10. Depending on production costs, the printing plates can be either divided or combined.

What is claimed is:

1. A sheet-fed printing machine for printing sheets in one or more colors utilizing an indirect printing process, the printing machine comprising, in combination:

a sheet-feeding unit, a plurality of sheet-guiding cylinders each of which is configured to transport only a single sheet at a time, a plate cylinder having a plurality of printing plates mounted thereon for transferring two differently colored partial images of a multicolor print image, a plurality of inking mechanisms which can be brought into and out of operative engagement with the plate cylinder on each revolution of the plate cylinder, and a rubber cylinder and a printing cylinder which together define a printing zone, the rubber cylinder having a circumference equal to a maximum length of the multicolor print image and wherein each sheet is conducted once through the printing zone in order to print the multicolor print image on the sheet.

2. The printing machine according to claim 1 wherein the printing cylinder has a diameter equal to twice the diameter of the rubber cylinder.

3. The printing machine according to claim 1 wherein the printing cylinder has a diameter equal to an odd-multiple of the diameter of the rubber cylinder.

4. The printing machine according to claim 1 wherein the sheet-feeding unit is adapted such that a sheet is not fed into the printing zone when print images are being collected on the rubber cylinder.

5. The printing machine according to claim 1 wherein the sheet-feeding unit is adapted such that a sheet is not fed into the printing zone when print images are being transferred from the rubber cylinder to a sheet held on the printing cylinder.

6. The printing machine according to claim 1 wherein the sheet feeding unit includes a feed drum which has a circumference equal to twice the maximum length of the multicolor print image and includes only one gripper row.

7. The printing machine according to claim 1 wherein the printing machine is configured for offset printing.

8. The printing machine according to claim 1 wherein the printing machine is configured for indirect intaglio printing.

9. The printing machine according to claim 1 wherein the printing machine is configured for indirect raised printing.

10. A process for printing of multicolor print images on sheets using a printing machine including a sheet-feeding unit, a plurality of sheet-guiding cylinders each of which is configured to transport only a single sheet at a time, a plate cylinder having a plurality of printing plates mounted thereon for transferring two differently colored partial images of a multicolor print image, a plurality of inking mechanisms which can be brought into and out of operative engagement with the plate cylinder on each revolution of the plate cylinder, and a rubber cylinder and a printing cylinder which together define a printing zone the rubber cylinder having a circumference equal to a maximum length of the multicolor print image and wherein each sheet is conducted once through the printing zone in order to print the multicolor print image on the sheet, the printing process comprising the steps of:

feeding sheets from the sheet feeding unit to the sheeting guiding cylinders in a cycle offset from the rotation of the sheet-guiding cylinders, transferring two partial images of a two-color print image from the plate cylinder onto the rubber cylinder, collecting the two partial images on the rubber cylinder in overlaid relation to one another, holding a sheet on the printing cylinder, and transferring the two partial images together onto the sheet in the printing zone.

11. The printing process according to claim 10 wherein the printing cylinder has multiple working surfaces and a diameter equal to a multiple of the diameter of the rubber cylinder and the sheets are fed into every other working surface.

12. The printing process according to claim 10 further including the step of removing the rubber cylinder from operative engagement with the plate cylinder upon printing of the last print image.

13. A process for printing of multicolor print images on sheets using a printing machine including a sheet-feeding unit, a plurality of sheet-guiding cylinders each of which is configured to transport only a single sheet at a time, a plate cylinder having a plurality of printing plates mounted thereon for transferring two differently colored partial images of a multicolor print image, a plurality of inking mechanisms which can be brought into and out of operative engagement with the plate cylinder on each revolution of the plate cylinder, and a rubber cylinder and a printing cylinder which together define a printing zone, the rubber cylinder having a circumference equal to a maximum length of the multicolor print image and wherein each sheet is conducted once through the printing zone in order to print the multicolor print image on the sheet, the printing process comprising the steps of:

applying two partial images of a two-color print image onto the rubber cylinder, feeding a first printing sheet from the sheet feeding unit to the printing cylinder such that both partial images are transferred from the rubber cylinder to the first sheet in register with one overlaid on the other, and feeding a second sheet from the sheet feeding unit to the printing cylinder only when the two partial images have again been collected on the rubber cylinder.

* * * * *